US007969325B2

(12) United States Patent
Hamilton, II et al.

(10) Patent No.: US 7,969,325 B2
(45) Date of Patent: Jun. 28, 2011

(54) PREEMPTIVE VARIABLE RATE TRAVEL FEES

(75) Inventors: Rick A. Hamilton, II, Charlottesville, VA (US); Naveen Lamba, Haymarket, VA (US); Colin Fung Wan Lim, Twickenham (GB); Benjamin G. Morris, Falls Church, VA (US); James W. Seaman, Falls Church, VA (US); Vinodh K. Swaminathan, Riverside, CT (US)

(73) Assignee: International Business Machines Corporation, Armonk, NY (US)

( * ) Notice: Subject to any disclaimer, the term of this patent is extended or adjusted under 35 U.S.C. 154(b) by 365 days.

(21) Appl. No.: 12/341,054

(22) Filed: Dec. 22, 2008

(65) Prior Publication Data

US 2010/0156670 A1 Jun. 24, 2010

(51) Int. Cl.
*G08B 1/00* (2006.01)
*G08G 1/00* (2006.01)
*G07B 15/00* (2011.01)

(52) U.S. Cl. ..... 340/928; 340/905; 705/13; 701/117; 701/118

(58) Field of Classification Search ..... 340/928; 701/118; 705/13
See application file for complete search history.

(56) References Cited

U.S. PATENT DOCUMENTS

| | | | |
|---|---|---|---|
| 6,411,889 | B1 | 6/2002 | Ichiro |
| 7,320,430 | B2 | 1/2008 | Dawson et al. |
| 2002/0072963 | A1 | 6/2002 | Jonge |
| 2004/0119609 | A1 | 6/2004 | Solomon |
| 2005/0168351 | A1 | 8/2005 | Saze et al. |

*Primary Examiner* — Donnie L Crosland
(74) *Attorney, Agent, or Firm* — Patrick J. Daugherty; Driggs, Hogg, Daugherty & Del Zoppo Co., LPA

(57) ABSTRACT

Variable thoroughfare toll rates are applied in anticipation of an event impacting traffic flow. An event occurrence is identified and determined to cause a change in a normal traffic flow amount on an impacted section of a thoroughfare. A traveler is notified of the impacted section of the thoroughfare in association with an impacted section-choice toll rate, a bypass choice in association with a bypass-choice toll rate, and a future time period duration for an application of the bypass-choice and impacted section-choice rates. A notified traveler is charged a toll for using the thoroughfare as a function of the bypass-choice rate in response to choosing to travel upon the presented bypass choice, or as a function of an impacted section-choice toll rate in response choosing to travel upon the presented impacted section choice.

20 Claims, 3 Drawing Sheets

PREEMPTIVE VARIABLE RATE TRAVEL FEES

FIELD OF THE INVENTION

The present invention generally describes methods, systems and devices for providing variable toll thoroughfare rates or other travel fees. More particularly, a rate may be selected as a function of anticipated or future events and traffic flows.

BACKGROUND OF THE INVENTION

Large traffic volumes on public thoroughfares may cause a number of problems. In one example traffic congestion and environmental impacts from vehicle emissions and other pollution generated by vehicle large traffic volumes on public thoroughfares may cause a variety of negative impacts. In order to improve quality of life for users of thoroughfares, as well as for people and areas impacted by their use and operation, it is desired to manage traffic volumes. However, traffic management may be difficult and complex.

More particularly, thoroughfare users have many different travel requirements, options, and habits. Roadway networks may include public roads, regional and intrastate highways, interstate highways, public toll and access roads, private toll and access roads, and each road in a given network may be negatively impacted by traffic carried by or diverted from another road. Traffic problems are not limited to roadways and other forms of public/mass transportation thoroughfares that may experience or cause traffic problems include canals, bridges and ferries. Users may also convey themselves along and to thoroughfares by variety of means, including apparatuses such as tram, train, bus, lorry, bicycle, wheelchair, taxicab, boat, plane, etc., and as well as self-locomotion by foot.

It is known to set thoroughfare user fees as a function of observed traffic volumes for a given fee-for-use thoroughfare, for example to discourage use and thereby reduce traffic volume on a turnpike by raising toll fees, or to encourage additional toll road use by lowering fees in order to attract vehicular traffic away from other congested roadways. However, setting toll rates in reaction to actual observed traffic conditions is of questionable effectiveness. For example, it may not be possible to determine if a future traffic reduction is responsive to a managed fare increase, or instead to perceived increases in commuting time or other factors by travelers. And variable fare setting may be perceived as arbitrary and punitive, particularly when imposed after traffic volumes and negative impacts have already occurred.

Traffic flows specific to one thoroughfare may also have direct or indirect impact on other thoroughfares or areas. A solution ameliorating a given set of traffic volume problems on one thoroughfare may only transfer the problem to another thoroughfare, or even create new problems. Fluctuations in traffic volumes may also be unrelated to fare setting, and even caused by factors outside of the thoroughfare environment itself or its direct management.

SUMMARY OF THE INVENTION

Methods are provided for applying variable thoroughfare toll rates in anticipation of an event impacting traffic flow. An event occurrence is identified and determined to cause a change in a normal traffic flow amount on an impacted section of a thoroughfare. A future time period duration of the change in the normal traffic flow amount on the impacted section is determined, and a bypass-choice toll rate and a different impacted section-choice toll rate are set. A traveler is notified of the impacted section of the thoroughfare in association with the impacted section-choice toll rate, a bypass choice in association with the bypass-choice toll rate, and an application of the bypass-choice toll rate and the impacted section-choice toll rate during the future time period duration. The notified traveler, presented with a choice of travelling upon the bypass-choice or the impacted section-choice prior to or during the future time period, is charged a toll for using the thoroughfare as a function of the bypass-choice rate in response to choosing to travel upon the presented bypass choice, or as a function of an impacted section-choice toll rate in response choosing to travel upon the presented impacted section-choice.

In another aspect, service methods are provided comprising deploying applications for applying variable thoroughfare toll rates in anticipation of an event impacting traffic flow according to the method steps described above, for example by a service provider who offers to implement, deploy, and/or perform functions for others. Still further, articles of manufacture comprising a computer usable medium having a computer readable program in said medium are provided. Such program code comprises instructions which, when executed on a computer system, cause the computer system to perform one or more method and/or process elements described above for applying variable thoroughfare toll rates in anticipation of an event impacting traffic flow. Moreover, systems, articles and programmable devices configured for performing one or more method and/or process elements of the current invention are also provided for applying variable thoroughfare toll rates in anticipation of an event impacting traffic flow, for example as described above.

BRIEF DESCRIPTION OF THE DRAWINGS

These and other features of the methods, systems and devices according to the present application will be more readily understood from the following detailed description of the various aspects of the embodiments taken in conjunction with the accompanying drawings in which.

Figure 1:
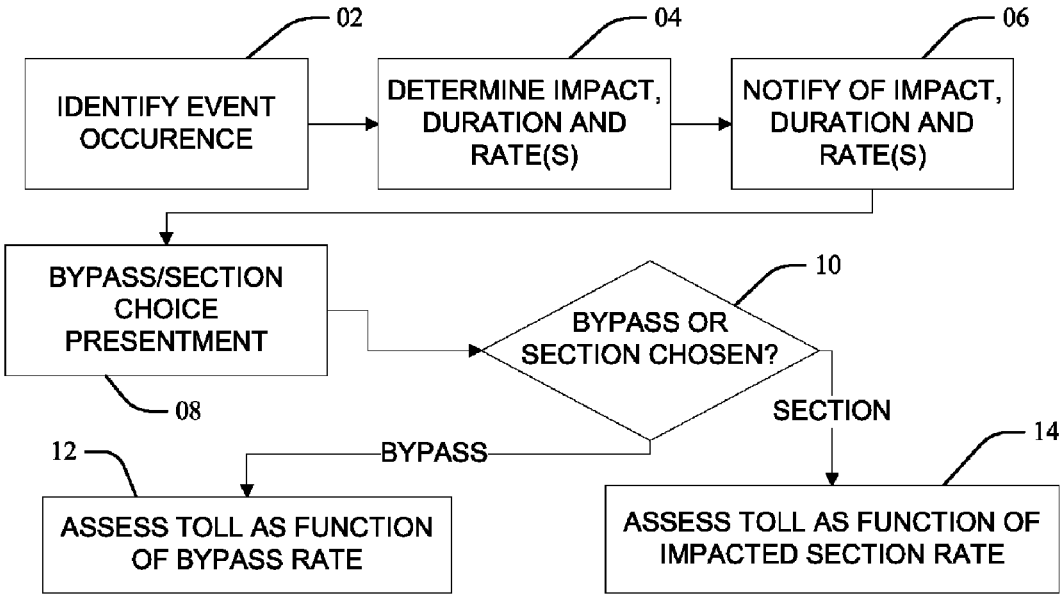
FIG. 1 is a flow chart illustrating a method and system for applying variable toll thoroughfare rates in anticipation of an event impacting traffic flow according to the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

For convenience the Detailed Description of the Invention has the following sections:

I. General Description; and

II. Computerized Implementation.

I. General Description

The present application discloses systems, methods, devices and program products for selecting and applying variable thoroughfare toll fees and rates. Variable travel fees may be determined as a function of traveler or vehicle origin or destination indicia, for example as associated with property types of same and/or proximity to certain resources. In one aspect similar thoroughfare usage by similar travelers or vehicles may result in differentiated rates determined as a function of associated geographic property usage and characteristics. Additionally, as used in the present application, the terms "toll" and "travel fee" refer not only to tolls or other fees associated with specific and designated toll or fee-for-use thoroughfares, but also to any fee or charge, or any credit or benefit, that may be assessed or awarded in association with a thoroughfare by a traveler. For example, a travel fee according to the present invention may comprehend a car-pool credit awarded, or a fee charged or debited from an account in response to travel on any road, including free-ways and secondary roads, in traveling from an origin point to a destination point, and other examples will be apparent to one skilled in the art. Global Positioning Satellite (GPS) systems may also be used to track vehicle road use independent of toll road use and associated toll collection systems, thus extending toll, fees and credit award according to the present invention beyond conventional toll thoroughfares.

Moreover, thoroughfares according to the present invention are not limited to vehicular roadways, and other illustrative but not exhaustive examples include canals, bridges and ferries, as well as mass passenger examples such as planes, trains, buses, lorries, ferries, taxicabs, boats, planes, etc. Vehicles may also travel along dedicated thoroughfare infrastructure (e.g. railroad tracks), or define a thoroughfare through their regular paths and schedules (e.g. a shipping channel or inter-coastal waterway). Additionally, though thoroughfare tolls are most commonly associated with user travel through private vehicles or other conveyance apparatus, they may also be utilized by users travelling under their own power (e.g. by bicycle or wheelchair), and also without any apparatus (by foot as a pedestrian over a toll bridge, or onto a ferry, etc.).

Automobiles are commonly known powered vehicles and generally desired for use in daily transportation for commuters of all kinds. Growing numbers of vehicles on roadways in many areas cause increases in problems and negative impacts from corresponding increases in powered vehicle traffic congestion and associated environmental pollution. As travelers have many differing travel requirements, options, and habits, management of traffic on toll thoroughfares such as turnpikes and other public and private toll roads should also contemplate conditions on other/associated traffic arteries such as other roads (illustrative but not exhaustive examples include public roads, regional and intrastate highways, interstate highways, access roads) and on forms of available mass transportation (illustrative but not exhaustive examples include trains, buses, ferries, etc.).

FIG. 1 illustrates a method and/or system for applying variable thoroughfare travel fees in anticipation of an event impacting traffic flow. At 02 a present or future event occurrence is identified or otherwise determined that will have an impact on traffic flow efficiencies on a toll thoroughfare. The event may be planned (e.g. a sporting event or music concert) or unplanned (e.g. a traffic accident, large structure fire located along a thoroughfare, etc). At 04, the impact of the event upon the thoroughfare is determined; more particularly one or more sections of the toll thoroughfare that will experience a current or expected future change (e.g. increase or decrease) in a normal traffic flow as a result of a traffic impact of the event occurrence are identified. For example, determining that an event occurrence will cause a change in a normal traffic flow amount may comprise analyzing collected data for a relevance of the event to a traffic flow of the thoroughfare. Normal traffic flow refers to an accepted or expected traffic flow under normal operating conditions, and may be identified through a variety of ways, for example a current traffic flow observed with no presently known impact events may set as the normal flow, or it may be a designed flow based on thoroughfare design, and other examples will be apparent to one skilled in the art.

Duration of the high-traffic impact on the identified sections is also determined at 04, for example defined as a period from an estimated time of onset of the determined or expected change in flow traffic on the identified section(s) through an estimated time of abatement of the change in traffic flow. The onset time may be contemporaneous with identification of a currently-occurring event, and thus an immediate time, or it may be a future time of a later commencement of the event or its expected traffic impact; in either event the duration will extend into the future, and thus the duration time defines a future time period of traffic impact/change in traffic flow.

One or more rates, or a variable rate algorithm, is/are also set at 04 for use of the toll thoroughfare during the future time period of traffic impact/change in traffic flow, and more particularly set to charge a higher rate for use of an impacted section during a negative/high traffic impact duration, or a lower rate for use of the impacted section during a positive/low traffic impact duration, relative to a rate charged when the impact ends or is diminished. In the present example, two rates are set: a bypass-choice toll rate for application to toll thoroughfare travelers that choose to use a bypass option that diverts them from use of the impacted section during the future impact time period duration; and a different (higher or lower) impacted section-choice toll rate for application to toll thoroughfare travelers that choose instead to use impacted section during the future time period duration.

At 06 a potential or current traveler or other user of the thoroughfare is notified of the determined event occurrence, and of a variable toll rate enacted with respect to travel associated with the impacted thoroughfare section(s) as a result of the event during the future time period. In the present example, a traveler is notified of an identification of the impacted section(s) of the thoroughfare and the impacted section-choice toll rate set and associated therewith; a bypass choice electable and the bypass-choice toll rate set and associated therewith; and an establishment or other implementation of the bypass-choice toll rate and the impacted section-choice toll rate during the future time period duration.

Subsequently, at 08 the notified traveler is presented with a choice during the future time period of either travelling upon or bypassing the thoroughfare section, for example choosing to use the identified bypass or instead to continue travelling upon the toll thoroughfare through or along the impacted section(s). Thus, according to the present invention, the informed traveler is enabled, and may be encouraged by a value differential between an impacted section-choice toll rate and a bypass-choice toll rate, to select an option associated with a better (e.g. lower cost) toll rate. For example, the traveler may be informed at 08 that the impacted section-choice toll rate is more costly than the bypass-choice toll rate, encouraging the traveler to select the bypass and avoid the impacted thoroughfare section(s) experiencing or expected to experience heavy traffic flows. Alternatively, where the impact change is a lowering of normal traffic flows on the impacted section(s), the traveler may be informed at 08 that the impacted section-choice toll rate is less costly than the bypass-choice toll rate, encouraging the traveler to elect the impacted toll thoroughfare section(s) over the bypass choice (thus helping to mitigate potential or actual heavy traffic problems on the bypass or alternative roads associated therewith). The traveler is also free to choose and utilize a less-preferred choice (as indicated by a higher associated toll rate) of the bypass or the impacted section.

In the present example at 10, the traveler's choice of bypass or impacted thoroughfare section(s) is noted or determined, and the traveler is accordingly charged a toll rate selected as a function of his choice; the traveler is charged the bypass-choice toll rate at 12 for choosing the presented bypass at 10, or if the traveler instead chooses to use the impacted thoroughfare section at 10, then at 14 the traveler is charged the impacted section-choice toll rate. Although the rate may be set in this example as function of opportunities presented and elected or non-elected, other embodiments may set rates for use independent of the presence of bypass options, for example setting a higher rate for a high-traffic impacted section during the duration of the impact regardless of a by-pass option presentment to a traveler.

The present invention provides advantages in the design and management of existing, planned, or proposed toll thoroughfares with respect to traffic impact in the context of other/associated traffic arteries, as well as on the environment. For example, it is generally desired to increase the green nature of traffic flows: to move traffic more efficiently, thereby reducing associated energy usage and negative environmental impacts associated with generating the energy, as well as reducing emissions and other impacts from the traffic flow itself. With respect to regional toll or transit systems, such considerations may contemplate larger or even national level perspectives; for example, it may be better to increase traffic flow on a first toll road relative to a second toll road in another state or distant region due to greater efficiencies/less impact from moving the same traffic volume on the first toll road relative to the second. Prior art thoroughfare management methods and systems that are responsive solely to the needs and flows of a managed thoroughfare, and ignore larger contextual travel system attributes and requirements, have difficulty balancing the requirements and desires of commuters against such things as regional and local traffic congestion, environmental impact, availability and use of nearby or associated mass transit options, and equitable distribution of travel costs among other thoroughfares. In contrast, the present invention enables regional traffic flow management through informing and financially rewarding or encouraging travelers to make optimal toll thoroughfare use choices dynamically (in response to current traffic impact events), and proactively by enabling advance planning of toll thoroughfare use in response to future event and traffic impact information communications.

Thus, the present invention provides for toll thoroughfare fare setting and management responsive to specific planned and unplanned events that cause increases in or excesses of traffic on toll thoroughfare and/or alternative and associated bypass options. Travel fee schedules may be revised or based on unplanned and real-time events such as traffic accidents, emergency road repairs or cleanups, emergency route closures, and alternate route closures and detours due to weather events and acts of nature (e.g. from a tree fallen across a roadway, or electrical wires down). Planned events may also cause or be expected to cause excess traffic on toll thoroughfares or other associated and alternative thoroughfares and mass transit options utilized by attendees. Information and data associated with planned events may be collected from local venues, published media (newspapers, internet advertising, artist web sites, local media web sites, broadcast media, etc.), and also directly from entities (e.g. concert promoters, permit granting agencies, etc.), the information used to identify event occurrences having traffic impacts and responsively generate increased fee schedules.

Thus, according to the present invention, scheduled general or localized traffic-impact events such as sporting events, civic events (e.g. parades, farmers markets, organized protest events), special events (e.g. a post office on a scheduled tax return filing date) and holidays may be identified and their associated impacts determined, for example at 02 and 04 in a method or process of FIG. 1 discussed above. In one example, a holiday may expect to cause heavy traffic for ingress and egress to a beach or public park, or on a given toll road that typically carries large volumes of travelers returning to large metropolitan areas or to significant nearby resort, recreational or vacation areas. With respect to some large venues (e.g., stadiums, arenas, ballparks, coliseums, etc.), almost any planned event may be expected to cause traffic impacts relevant to an associated toll thoroughfare. In another aspect events may be considered within larger or regional contexts; thus, a ballpark event supported by large-capacity roads and mass transit may not cause toll rates to vary unless another event in an adjacent arena is also planned, or unless the ballpark setting is urban and the event end or beginning time is contemporaneous with a local commuter rush hour.

In another aspect of the present invention, giving advance notice to travelers of higher event-specific fees encourages the travelers to use alternatives during a duration of the traffic impact of the event, limiting or ameliorating gross traffic congestion or increases in proportion to the number of notified travelers who opt for an alternative thoroughfare, or an alternative time-of-use of the present managed thoroughfare (e.g., revising a time or date of travel to a period before or after a high-traffic period associated with the event). Such preemptive reductions help to avoid inefficient use of the thoroughfare, reducing the time that vehicles are occupying the thoroughfare and wasting fuel through increased idling in traffic stoppages or moving at less efficient travel speeds due to traffic congestion, also thereby reducing the higher generation of pollutants associated with inefficient travel.

Thus, savings and advantages according to the present invention are realized by communicating enhanced event-based fees to travelers traveling during a traffic increase impact period associated with the event, wherein the notified travelers are given options to leave the thoroughfare or otherwise alter their travel to avoid the toll thoroughfare or section thereof impacted by the enhanced toll rates. Notice of event-based fare increases may also be conveyed to travelers moving toward and in the direction of a traffic impact from an event before they encounter impacted sections of the thoroughfare, thus enabling travelers to opt out of using the thoroughfare before they get stuck in an associated traffic jam, and thereby proportionately reducing total traffic flows prior to ripening of traffic impact from the event, in some examples even reducing traffic flow enough to prevent a negative traffic flow impact from developing or arising.

Future and current variable travel fee schedules may be published to vehicle operators using a variety of means. Travelers may be notified in advance of event-based toll increases through publishing travel fee schedules to print media (e.g. newspapers, bulletins) and broadcast media (e.g. television, radio, internet streaming, internet web pages), enabling a traveler to plan for alternative routes well in advance, including before embarking on a trip. Travelers may also receive notice of variable or revised travel fee schedules en route. For example, referring to FIG. 2, an operator 22 of vehicle 24 travelling along a toll thoroughfare 142 may be notified of event-based toll setting or variation schedule according to the present invention through an automobile data or GPS system 28 (for example, an OnStar® or Garmin® system; ONSTAR is a trademark of the OnStar Corporation in the United States, other countries, or both; and GARMIN is a trademark of Garmin Ltd. in the United States, other countries, or both); through conventional or satellite radio systems 29, through a personal data device 30 (e.g. a personal digital assistant (PDA) device, a personal computer or a cellular telephone device); through electronic/programmable roadway signs 32 located near the roadway and configured to communicate text information 34 to the traveler; and through communications to a vehicle toll transponder 62 from a toll thoroughfare transponder 64 provided along the toll thoroughfare 142. Each of the devices 28/29/30/32/62/64 may be in wired or wireless data communication with a toll thoroughfare authority or service provider 36 who provides toll schedules and updates to any one of the devices 28/29/30/32/62/64. Travel safety may be enhanced by configuring any one of the devices 28/29/30/32/62/64 to communicate toll rate information and/or suggested rerouting through an audio message 38 to the vehicle operator 22 through amplified speaker means 37 of, or in wired or wireless communication with, any of the devices 28/29/30/32/62/64.

As discussed above, in another aspect of the present invention, variable tolls may be varied or toll rate alternatives selected and assessed based on traveler responses to such notification. FIG. 3 illustrates one example of a toll road 142 comprising one section 144 experiencing an unplanned event-based traffic flow slowdown situation (e.g. an accident has occurred within the impacted section 144); accordingly, automobiles or autos 24*a*, 24*b* and 24*c* (as understood with reference to the generic vehicle 24 configuration described in FIG. 2) traveling in a direction toward the impacted section 144 are each promptly notified of an enhanced or variable toll rate presently in effect for use of the impacted section 144, for example through one or more of the notification methods and systems illustrated in FIG. 2 and discussed above. However, auto 24*a* has no exit opportunity between its present location and the impacted section 144, and thus is unable to avoid travelling toward and eventually upon the impacted section 144. In contrast, auto 24*b* is approaching a cross-roads 152 with an alternative bypass roadway 154, and auto 24*c* is approaching an exit-interchange 156 with an alternative freeway 158, the alternative freeway 158 further engaging another high-volume freeway 160 through an interchange 162. Accordingly, as auto 24*a* has no exit opportunity prior to engaging the impacted section 144, it may be unfair to increase toll fees for auto 24*a* who has no option but to proceed toward the impacted section 144; moreover, as auto 24*a* may also have to endure the inconvenience and delay of traffic stoppage in the impacted section 144, charging a higher toll rate for the auto's 24*a* user of the impacted section 144 may be even more unfair or otherwise contraindicated with respect to an owner or operator of auto 24*a*.

In contrast, auto 24*b* has received sufficient notice enabling it to exit the toll thoroughfare 142 at the crossroads 152, and auto 24*c* may exit at both the crossroads 152 and at the interchange 156. In one aspect of the present invention, higher toll rates may be assessed to travelers for using impacted thoroughfare sections, determined as a function of choices made and opportunities presented to avoid use of (or avail themselves of) the impacted section. Thus, a notified traveler in auto 24*b* who decides to pass roadway exit 152, which may provide an opportunity to stop (for example, for a rest stop or a coffee break while waiting for traffic to clear from the impacted section), instead proceeding into the impacted area 144 (sitting in a traffic jam and further exacerbating the situation as well as adding to his or her auto 24*b* emissions to an overall pollution impact of the toll thoroughfare 142), may be assessed a higher fee or toll rate than that assessed to auto 24*a*. And a notified traveler in auto 24*c* who decides to pass both roadway exits 152 and 156 and proceed into the impacted area 144 may be assessed a higher fee than that levied upon auto 24*b*, wherein the fee or toll rate is increased with each sequential exit opportunity 152 passed up after an earlier opportunity 156 and without egress from the toll thoroughfare 142; in some examples progressively increasing or progressively decreasing a fee or toll rate with each choosing by the traveler.

Attributes of each exit or bypass opportunity/choice may also be considered. For example, in the present example, the interchange 156 offers a bypass option comprising access to the parallel high-traffic capacity freeway 160, on which can handle much more diverted traffic than a secondary road 162 accessed through the crossroads exit 152. As it may be desired to divert most if not all traffic to the freeway 160, toll reductions may be much greater for exiting at 156 relative to exiting at 152.

Fees and toll rates may also be differentiated for autos warned of the impacted section 144 prior to entering the toll thoroughfare 142 via an entrance or ramp: for example, if auto 24*d* travelling along highway 158 enters the toll thoroughfare 142 at interchange 156 and travels toward the impacted section 144, the auto 24*d* may be assessed a higher intentional-access fee or rate than that levied upon autos 24*c*, 24*b* or 24*a*. Further, preferred-status attributes of the bypass or detour routing offered by remaining upon freeway 158 and using the parallel high-traffic capacity freeway 160 may also be considered, for example indicating a higher intentional-access fee or rate for the auto 24*d* who enters the thoroughfare 142 at the exchange 156 relative to one charged auto 24*b* for entering the toll thoroughfare 142 at crossroads 152, even though crossroads 152 may be more proximate to the impacted section 144 than the interchange 156.

Travelers may also be encouraged to exit the toll thoroughfare 142 prior to encountering the impacted section 144 by reducing rates or amounts of tolls normally charged at exits or egress opportunities. Thus, in the present example, auto 24*c* may be notified that (or have prior knowledge that) a toll charged upon exiting at interchange 156 or crossroads 152 will be reduced from a present or normal charge during the duration of a high-traffic period at the impacted section 144. Reductions may also be differentiated, for example, progressively reducing rates or amounts of reduction of tolls after each non-selected bypass options: in one example, if auto 24*c* exits at the first opportunity at interchange 156 an entire toll may be waived, wherein exiting instead at the second opportunity at crossroads 152 results in a reduced toll but not a waiver.

Referring again to FIG. 2, data obtained and used with respect to the present invention may be stored and retained by the toll thoroughfare authority/service provider 36. Some embodiments may utilize one or more relational databases, which may provide advantages in scalability, ease of record association, and ease of data access for view and update. Toll rate and charging data may be obtained from and exchanged with vehicle transponders 62 and/or toll thoroughfare transponders 64. Thus, in one embodiment, a transponder 62 carried by or attached to the vehicle 24 is programmed with appropriate personal and business rate data, the data provided to the toll authority/service provider 36 through wireless communication with a toll thoroughfare transponder 64. The toll thoroughfare transponders 64 may also directly scan vehicles 24 travelling by and acquire data indicative of toll rate notification times, applicable toll rates and actual toll thoroughfare use from the transponder 62, from communicating with one of the devices 28/29/30 associated with the vehicle 24, or by scanning a vehicle license plate 66 or other indicia tag 66 (e.g., optically scanning a license plate 66 or using Radio Frequency Identification (RFID) methods and systems to scan an RFID tag 66 comprising unique Vehicle Identification Number (VIN) data. For example, with reference to both FIGS. 2 and 3, data from or provided to toll thoroughfare transponders 64 deployed along the toll thoroughfare 142 and egress and ingress interchanges 152 and 156, may be used to determine origin and positioning of the respective autos 24*a*/24*b*/24*c*/24*d* along the toll thoroughfare 142 in order to apply variable toll rates according to the present invention.

Tolls may be collected using manual and automated devices and systems, including fare boxes and automated toll collection systems (ETC), for example incorporating EZ-Pass® and/or SunPass® systems and the like (EZ-PASS is a Trademark of the EZ-Pass Interagency Group in the United States and/or other countries; SUNPASS is a trademark of the Florida Department of Transportation in the United States and/or other countries). Global Positioning Satellite (GPS) systems may also be used to track vehicle road use independent of toll road use and associated ETC systems, thus extending toll, fees and credit awards according to the present invention beyond conventional toll thoroughfares. Such automated embodiments offer advantages in enabling simplified implementation, management, and modification of variable rate tolls. In one embodiment discounts are only available to commuters equipped to use an ETC/GPS system, and in another embodiment a higher toll is paid by those commuters not equipped for ETC or GPS. In other examples a one-time discount, a temporarily reduced toll fee or a long term reduced toll fee is offered to entice commuters to switch to automated ETC or GPS systems. ETC and GPS systems may also comprehend municipal parking collection systems; vehicle service, fueling or charging stations, for example incorporated into automated fueling pumps or charging stations. Toll fees may also be assessed and collected through other payment and debiting systems and events, for example upon payment of taxes, renewal of a drivers license, payment of regulated utility bill, and the like; or tolls may be invoiced for remittance by the vehicle 24 owner or operator, or even passenger 22 thereof.

Thus, the present invention addresses the problem of pollutants caused by excess vehicular traffic on the roadways during specific heavy travel periods caused by both planned and unplanned events, and may discourage individual vehicle travel during said specific heavy travel periods by imposing higher travel fees during these periods. Similarly, if the impacted section 144 is instead experiencing a lower-than-normal traffic flow or volume, or this section is otherwise preferred over bypass options (e.g. high traffic or construction delays on the parallel freeway 160), then toll rates may be decreased or otherwise set to encourage use of the impacted section 144. Accordingly, in some embodiments, auto 24*c* may be notified of a reduced rate, or waiver of rate, for use of the impacted section 144 in order to encourage auto 24*c* to remain on the toll thoroughfare 142 rather than exit/bypass at 156 and proceed to use the freeway 160.

Although it is known in the prior art to vary tolls responsive to existing congestion, or to regular business and rush hour periods, the present invention enables proactively and pre-emptively setting toll rates in advance of other events predicted or determined that cause traffic congestion impacts, events and associated impacts that the commuter or traveler will not otherwise be aware of or consider in using a thoroughfare. By varying rates well in advance of the expected traffic impact, and notifying of the specific sections and duration and time periods of effectiveness of the rates, heavy traffic conditions may be prevented from developing by causing a pre-emptive reduction in traffic volume by notified and responsive travelers, those who alter their trip plans in response to the differentiated fare setting. Thus, the present invention allows commuters to make transit choices with respect to otherwise unexpected heavy traffic time periods.

Figure 2:
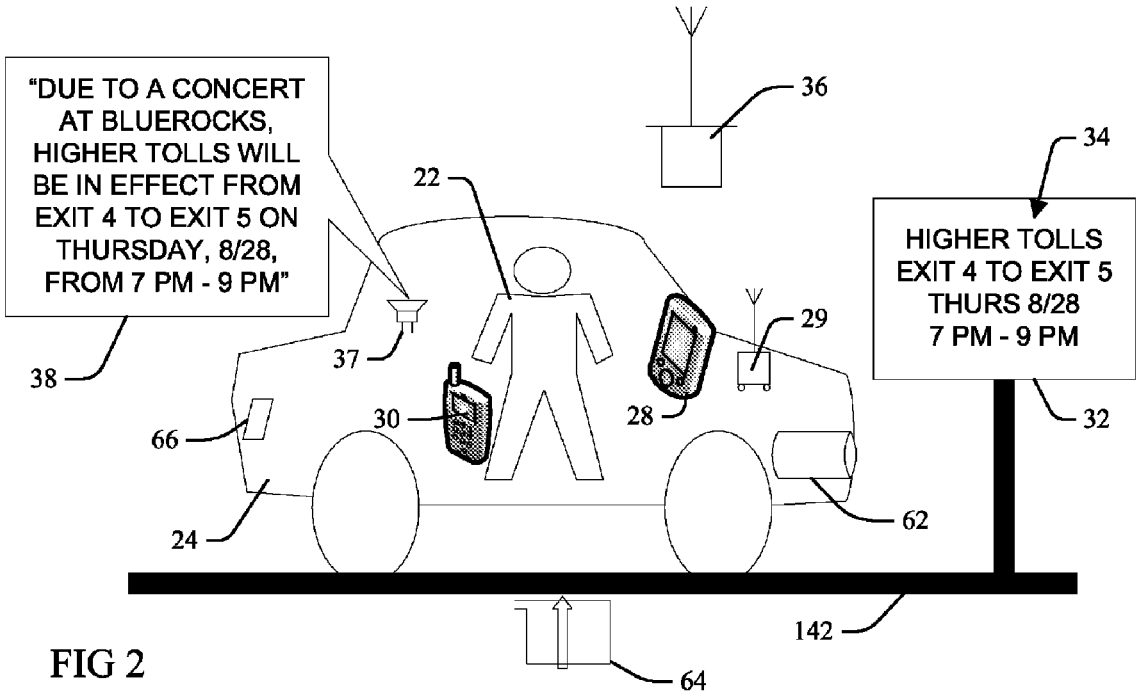
FIG. 2 is diagrammatic illustration of an implementation of a method or system for applying variable toll thoroughfare rates in anticipation of an event impacting traffic flow according to the present invention.
Figure 3:
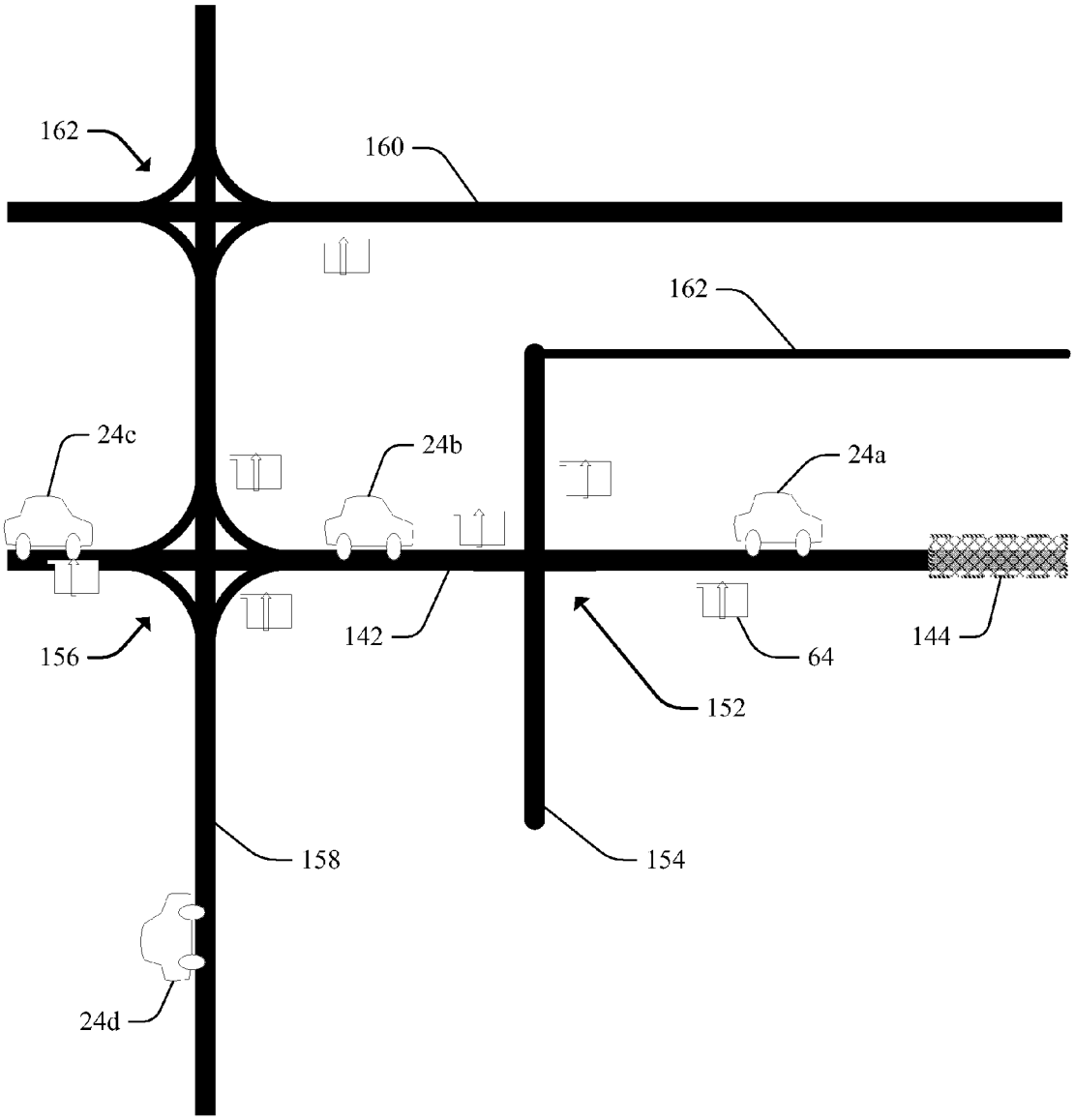
FIG. 3 is diagrammatic illustration of an implementation of a method or system for applying variable toll thoroughfare rates in anticipation of an event impacting traffic flow according to the present invention.
Figure 4:
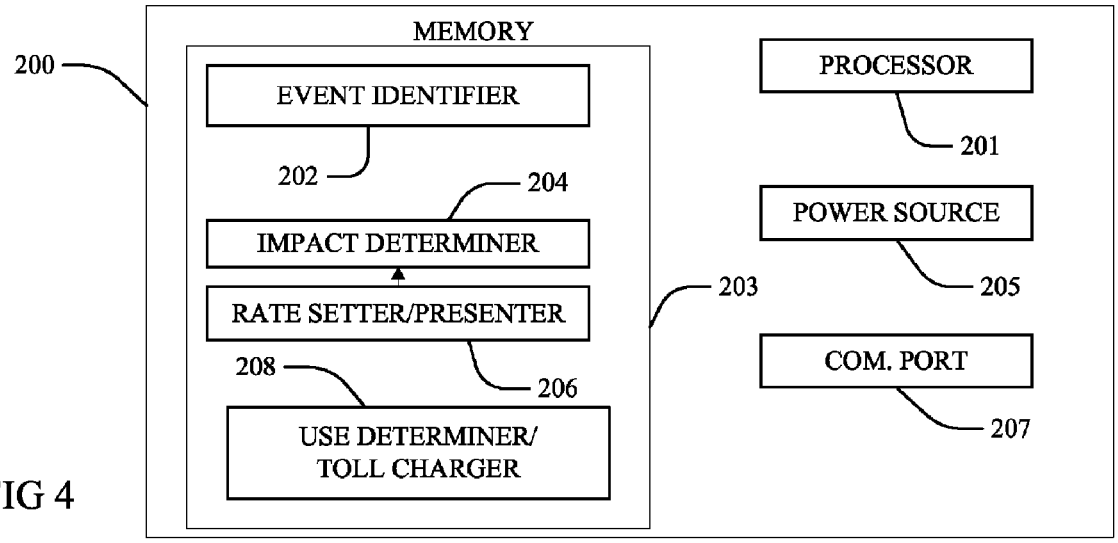
FIG. 4 is a block diagram of a system or device configured to enable the application of variable toll thoroughfare rates in anticipation of an event impacting traffic flow according to the present invention.

FIG. 4 illustrates a programmable device or module 200 configured to select and apply variable toll thoroughfare rates in anticipation of an event impacting traffic flow according to the present invention, for example as illustrated in FIGS. 1-3 and described above. The device 200 may be incorporated into a large system wherein other components of the system accomplish systems and methods according to the present invention, or it may be a stand-alone device or module configured to perform each of the systems and methods, such as the transponder device or module 62/64 of FIG. 3. The present embodiment comprises a central processing unit (CPU) or other processing means 201 in communication with a memory 203, the memory 203 comprising logic components that enable the CPU 201 to perform processes and methods according to the present application. The memory 203 comprises an event identifier logic component 202, the event identifier configured to identify current and future, planned and unplanned event occurrences that are presently impacting or will impact traffic flow on at least a section of a toll thoroughfare as discussed above with respect to FIGS. 1-3; an impacted section determiner logic component 204, configured to determined a section or sections of the toll thoroughfare that will experience traffic flow impacts as discussed above with respect to FIGS. 1-3; a toll rate setter and presenter logic component 206, configured to set variable or multiple toll rates and present them to travelers as a function of proximity in time or distance to the impact section(s) and bypass options relevant thereto, for example as discussed above with respect to FIGS. 1-3; and a toll thoroughfare use determiner and toll charger logic component 208, configured to select and apply an appropriate toll rate or fee for use of the toll thoroughfare relative to the notified impacts and selections and behaviors of a toll thoroughfare user in response thereto, for example as discussed above with respect to FIGS. 1-3. A power unit 205 is configured to provide operative power to the device 200; examples include battery units 205 and power inputs configured to receive alternating or direct current electrical power, and other appropriate power units 205 will be apparent to one skilled in the art. A communication port or network link/node means 207 is also provided and configured to enable network and other communications with other devices, systems, monitoring, administrative and service provider entities, as well as others as appropriate.

II. Computerized Implementation

Figure 5:
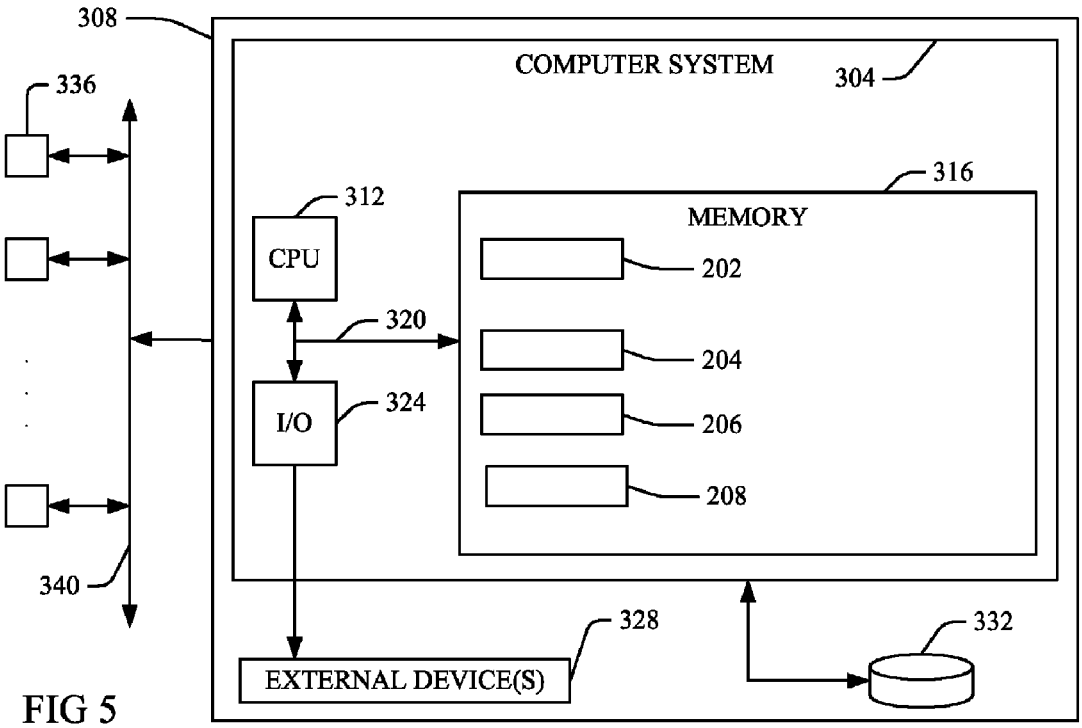
FIG. 5 is a block diagram illustrating a computerized implementation of a method and system for applying variable toll thoroughfare rates in anticipation of an event impacting traffic flow according to the present invention.

Referring now to FIG. 5, an exemplary computerized implementation of the present invention includes a computer system 304 deployed within a computer infrastructure 308 such as a computer or a programmable device such as a personal digital assistant (PDA) or cellular phone. This is intended to demonstrate, among other things, that the present invention could be implemented within a network environment 340 (e.g., the Internet, a wide area network (WAN), a local area network (LAN), a virtual private network (VPN), etc.) in communication with one or more additional computers 336, or on a stand-alone computer infrastructure 308. In the case of the former, communication throughout the network 340 can occur via any combination of various types of communication links. For example, the communication links can comprise addressable connections that may utilize any combination of wired and/or wireless transmission methods. Where communications occur via the Internet, connectivity could be provided by conventional TCP/IP sockets-based protocol, and an Internet service provider could be used to establish connectivity to the Internet.

As shown, the computer system 304 includes a central processing unit (CPU) 312, a memory 316, a bus 320, and input/output (I/O) interfaces 324. Further, the computer system 304 is shown in communication with external I/O devices/resources 328 and storage system 332. In general, the processing unit 312 executes computer program code, such as the code to implement various components of the process and systems, and devices as illustrated in FIGS. 1-4 and described above, including the event identifier logic component 202, the impacted section determiner logic component 204, the toll rate setter and presenter logic component 206 and the toll thoroughfare use determiner and toll charger logic component 208, discussed above and, which are stored in memory 316 and/or storage system 332. It is to be appreciated that two or more, including all, of these components may be implemented as a single component.

While executing computer program code, the processing unit 312 can read and/or write data to/from the memory 316, the storage system 332, and/or the I/O interfaces 324. The bus 320 provides a communication link between each of the components in computer system 304. The external devices 328 can comprise any devices (e.g., keyboard, pointing device, display, etc.) that enable a user to interact with computer system 304 and/or any devices (e.g., network card, modem, etc.) that enable computer system 304 to communicate with one or more other computing devices.

The computer infrastructure 308 is only illustrative of various types of computer infrastructures for implementing the invention. For example, in one embodiment, computer infrastructure 308 comprises two or more computing devices (e.g., a server cluster) that communicate over a network to perform the various process steps of the invention. Moreover, computer system 304 is only representative of various possible computer systems that can include numerous combinations of hardware.

To this extent, in other embodiments, the computer system 304 can comprise any specific purpose-computing article of manufacture comprising hardware and/or computer program code for performing specific functions, any computing article of manufacture that comprises a combination of specific purpose and general-purpose hardware/software, or the like. In each case, the program code and hardware can be created using standard programming and engineering techniques, respectively. Moreover, the processing unit 312 may comprise a single processing unit, or be distributed across one or more processing units in one or more locations, e.g., on a client and server. Similarly, the memory 316 and/or the storage system 332 can comprise any combination of various types of data storage and/or transmission media that reside at one or more physical locations.

Further, I/O interfaces 324 can comprise any system for exchanging information with one or more of the external device 328. Still further, it is understood that one or more additional components (e.g., system software, math co-processing unit, etc.) not shown in FIG. 4 can be included in computer system 304. However, if computer system 304 comprises a handheld device or the like, it is understood that one or more of the external devices 328 (e.g., a display) and/or the storage system 332 could be contained within computer system 304, not externally as shown.

The storage system 332 can be any type of system (e.g., a database) capable of providing storage for information under the present invention. To this extent, the storage system 332 could include one or more storage devices, such as a magnetic disk drive or an optical disk drive. In another embodiment, the storage system 332 includes data distributed across, for example, a local area network (LAN), wide area network (WAN) or a storage area network (SAN) (not shown). In addition, although not shown, additional components, such as cache memory, communication systems, system software, etc., may be incorporated into computer system 304.

While shown and described herein as a method and a system, it is understood that the invention further provides various alternative embodiments. For example, in one embodiment, the invention provides a computer-readable/useable medium that includes computer program code to enable a computer infrastructure to implement methods, systems and devices according to the present application, for example as illustrated in FIGS. 1-5 above and described otherwise herein. To this extent, the computer-readable/useable medium includes program code that implements each of the various process steps of the present application.

It is understood that the terms "computer-readable medium" or "computer useable medium" comprise one or more of any type of physical embodiment of the program code. In particular, the computer-readable/useable medium can comprise program code embodied on one or more portable storage articles of manufacture (e.g., a compact disc, a magnetic disk, a tape, etc.), on one or more data storage portions of a computing device, such as the memory 316 and/or the storage system 332 (e.g., a fixed disk, a read-only memory, a random access memory, a cache memory, etc.), and/or as a data signal (e.g., a propagated signal) traveling over a network (e.g., during a wired/wireless electronic distribution of the program code).

Still yet, computer infrastructure 308 is intended to demonstrate that some or all of the components of implementation according to the present application could be deployed, managed, serviced, etc. by a service provider who offers to implement, deploy, and/or perform the functions of the present invention for others, for example by licensing methods and browser or application server technology to an internet service provider (ISP) or a cellular telephone provider. In one embodiment, the invention may comprise a business method that performs the process steps of the invention on a subscription, advertising, and/or fee basis. Thus, a service provider can create, maintain, support, etc., a computer infrastructure, such as the computer infrastructure 308 that performs the process steps of the present application for one or more customers, and in return the service provider can receive payment from the customer(s) under a subscription and/or fee agreement and/or the service provider can receive payment from the sale of advertising content to one or more third parties.

In still another embodiment, the invention provides a computer-implemented method for enabling the processes, methods and devices according to the present application. In this case, a computer infrastructure, such as computer infrastructure 308, can be provided and one or more systems for performing the process steps of the invention can be obtained (e.g., created, purchased, used, modified, etc.) and deployed to the computer infrastructure. To this extent, the deployment of a system can comprise one or more of: (1) installing program code on a computing device, such as computer system 304, from a computer-readable medium; (2) adding one or more computing devices to the computer infrastructure; and (3) incorporating and/or modifying one or more existing systems of the computer infrastructure to enable the computer infrastructure to perform the process steps of the invention.

As used herein, it is understood that the terms "program code" and "computer program code" are synonymous and mean any expression, in any language, code or notation, of a set of instructions intended to cause a computing device having an information processing capability to perform a particular function either directly or after either or both of the following: (a) conversion to another language, code or notation; and/or (b) reproduction in a different material form. To this extent, program code can be embodied as one or more of: an application/software program, component software/a library of functions, an operating system, a basic I/O system/driver for a particular computing and/or I/O device, and the like.

Certain examples and elements described in the present specification, including in the claims and as illustrated in the figures, may be distinguished or otherwise identified from others by unique adjectives (e.g. a "first" element distinguished from another "second" of a plurality of elements, a "primary" distinguished from a "secondary," an "another", etc.) Such identifying adjectives are generally used to reduce confusion or uncertainty, and are not to be construed to limit the claims to any specific illustrated element or embodiment, or to imply any precedence, ordering or ranking of any claim elements, limitations or process steps.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

What is claimed is:

1. A method for applying variable thoroughfare toll rates in anticipation of an event impacting traffic flow, comprising:

identifying an event occurrence;

determining that the event occurrence will cause a change in a normal traffic flow amount on an impacted section of a thoroughfare;

determining a future time period duration of the change in the normal traffic flow amount on the impacted section;

setting a bypass-choice toll rate and a different impacted section-choice toll rate;

notifying a traveler of:

an identification of the impacted section of the thoroughfare in association with the impacted section-choice toll rate;

a bypass choice in association with the bypass-choice toll rate; and an application of the bypass-choice toll rate and the impacted section-choice toll rate during the future time period duration;

presenting the notified traveler with a choice of travelling upon the bypass choice or the impacted section, the presenting at a presentment time at least one of prior to and during the future time period;

charging a toll to the traveler for using the thoroughfare as a function of the bypass-choice rate in response to the traveler choosing to travel upon the presented bypass choice; and charging a toll to the traveler for using the thoroughfare as a function of an impacted section-choice toll rate in response to the traveler choosing to travel upon the presented impacted section choice.

2. The method of claim 1 wherein the identified event is a future-occurring event, and an onset time of the future time period is in a future time relative to the presentment time.

3. The method of claim 1, wherein the identifying the event comprises collecting event data from published media; and wherein the determining that the event occurrence will cause a change in a normal traffic flow amount comprises analyzing the collected data for a relevance of the event to a traffic flow of the thoroughfare.

4. The method of claim 1, further comprising charging a toll to the traveler for using the thoroughfare as a function of a lower of the bypass-choice rate and the impacted section-choice toll rate in response to an inability of the traveler to select between the choosing to travel upon the presented impacted section choice and the choosing to travel upon the presented bypass choice.

5. The method of claim 1, wherein presenting the notified traveler with the choice comprises presenting a plurality of bypass choices, further comprising:

increasing a total toll rate charged the traveler for the using the thoroughfare with each choosing of a use of the impacted section over a presented bypass choice, the impacted section-choice toll rate relatively higher than the bypass-choice rate; or decreasing a total toll rate charged the traveler for the using the thoroughfare with each choosing of a use of the impacted section over a presented bypass choice, the impacted section-choice toll rate relatively lower than the bypass-choice rate.

6. The method of claim 5, wherein presenting the notified traveler with the plurality of bypass choices comprises sequentially presenting each of the plurality of bypass choices; and wherein the increasing and the decreasing the toll rate charged comprises progressively increasing or progressively decreasing the toll rate with each choosing by the traveler.

7. The method of claim 5, further comprising the traveler moving toward and in the direction of the impacted section at each of the presentment times of the plurality of bypass choices, and wherein each of the presentment times is prior to a time of an encounter of the impacted section by the moving traveler.

8. The method of claim 5 wherein each of the plurality of bypass choices has a traffic flow capacity, and wherein a first of the bypass choices having a first traffic flow capacity greater than a second traffic flow capacity of a second of the bypass choices, further comprising:

setting a first bypass-choice toll rate for association with the first bypass choice lower than a second bypass-choice toll for association with the second bypass choice as a function of a difference between the first traffic flow capacity and the second traffic flow capacity.

9. The method of claim 8 wherein the plurality of bypass choices comprises an ingress to the thoroughfare choice enabling the traveler to move toward the impacted section on the thoroughfare from a high-capacity freeway, further comprising:

setting an intentional ingress-choice toll rate for association with the ingress choice higher than the first bypass choice toll and the second bypass-choice toll.

10. A service for applying variable thoroughfare toll rates in anticipation of an event impacting traffic flow, comprising:

providing a computer infrastructure configured to:

identify an event occurrence;

determine that the event occurrence will cause a change in a normal traffic flow amount on an impacted section of a thoroughfare;

determine a future time period duration of the change in the normal traffic flow amount on the impacted section;

set a bypass-choice toll rate and a different impacted section-choice toll rate;

notify a traveler of:

an identification of the impacted section of the thoroughfare in association with the impacted section-choice toll rate;

a bypass choice in association with the bypass-choice toll rate; and an application of the bypass-choice toll rate and the impacted section-choice toll rate during the future time period duration;

charge a toll to the traveler for using the thoroughfare as a function of the bypass-choice rate in response to the traveler choosing to travel upon a bypass choice presented at least one of prior to and during the future time period; and charge a toll to the traveler for using the thoroughfare as a function of an impacted section-choice toll rate in response to the traveler choosing to travel upon the presented impacted section choice.

11. The service of claim 10, wherein the identified event is a future-occurring event, and an onset time of the future time period is in a future time relative to the presentment time, the computer infrastructure configured to identify the event by analyzing event data from published media for a relevance of the event to a traffic flow of the thoroughfare.

12. The service of claim 11, the computer infrastructure configured to:

increase a total toll rate charged the traveler for the using the thoroughfare with each choosing of a use of the impacted section over a presented bypass choice, the impacted section-choice toll rate relatively higher than the bypass-choice rate; or decrease a total toll rate charged the traveler for the using the thoroughfare with each choosing of a use of the impacted section over a presented bypass choice, the impacted section-choice toll rate relatively lower than the bypass-choice rate.

13. The service of claim 12, wherein each of a plurality of bypass choices has a traffic flow capacity, and wherein a first of the bypass choices has a first traffic flow capacity greater than a second traffic flow capacity of a second of the bypass choice, the computer infrastructure configured to:

set a first bypass-choice toll rate for association with the first bypass choice lower than a second bypass-choice toll for association with the second bypass choice as a function of a difference between the first traffic flow capacity and the second traffic flow capacity.

14. The service of claim 13, wherein the plurality of bypass choices comprises an ingress to the thoroughfare choice enabling the traveler to move toward the impacted section on the thoroughfare from a high-capacity freeway, the computer infrastructure configured to set an intentional ingress-choice toll rate for association with the ingress choice higher than the first bypass choice toll and the second bypass-choice toll.

15. A method for applying variable thoroughfare toll rates in anticipation of an event impacting traffic flow, comprising:

producing computer executable program code;

storing the code on a computer readable medium; and providing the program code to be deployed and executed on a computer system, the program code comprising instructions which, when executed on the computer system, cause the computer system to:

identify an event occurrence;

determine that the event occurrence will cause a change in a normal traffic flow amount on an impacted section of a thoroughfare;

determine a future time period duration of the change in the normal traffic flow amount on the impacted section;

notify a traveler of:

an identification of the impacted section of the thoroughfare in association with an impacted section-choice toll rate;

a bypass choice in association with a bypass-choice toll rate; and an application of the bypass-choice toll rate and the impacted section-choice toll rate during the future time period duration;

charge a toll to the traveler for using the thoroughfare as a function of the bypass-choice rate in response to the traveler choosing to travel upon a bypass choice presented at least one of prior to and during the future time period; and charge a toll to the traveler for using the thoroughfare as a function of an impacted section-choice toll rate in response to the traveler choosing to travel upon the presented impacted section choice.

16. The method of claim 15, the program code comprising instructions which, when executed on the computer system, causes the computer system to:

increase a total toll rate charged the traveler for the using the thoroughfare with each choosing of a use of the impacted section over a presented bypass choice, the impacted section-choice toll rate relatively higher than the bypass-choice rate; or decrease a total toll rate charged the traveler for the using the thoroughfare with each choosing of a use of the impacted section over a presented bypass choice, the impacted section-choice toll rate relatively lower than the bypass-choice rate.

17. The method of claim 16, wherein each of a plurality of bypass choices has a traffic flow capacity, and wherein a first of the bypass choices has a first traffic flow capacity greater than a second traffic flow capacity of a second of the bypass choice, the program code comprising instructions which, when executed on the computer system, causes the computer system to set a first bypass-choice toll rate for association with the first bypass choice lower than a second bypass-choice toll for association with the second bypass choice as a function of a difference between the first traffic flow capacity and the second traffic flow capacity.

18. A programmable device comprising:

a processing means;

a memory in communication with the processing means comprising a logic component; and a network interface in communication with the processing means and the memory;

wherein the processing means is configured to:

identify an event occurrence;

determine that the event occurrence will cause a change in a normal traffic flow amount on an impacted section of a thoroughfare;

determine a future time period duration of the change in the normal traffic flow amount on the impacted section;

set a bypass-choice toll rate and a different impacted section-choice toll rate;

notify a traveler of:

an identification of the impacted section of the thoroughfare in association with the impacted section-choice toll rate;

a bypass choice in association with the bypass-choice toll rate; and an application of the bypass-choice toll rate and the impacted section-choice toll rate during the future time period duration;

charge a toll to the traveler for using the thoroughfare as a function of the bypass-choice rate in response to the traveler choosing to travel upon a bypass choice presented at least one of prior to and during the future time period; and charge a toll to the traveler for using the thoroughfare as a function of an impacted section-choice toll rate in response to the traveler choosing to travel upon the presented impacted section choice.

19. The programmable device of claim 18, wherein processing means is configured to:

increase a total toll rate charged the traveler for the using the thoroughfare with each choosing of a use of the impacted section over a presented bypass choice, the impacted section-choice toll rate relatively higher than the bypass-choice rate; or decrease a total toll rate charged the traveler for the using the thoroughfare with each choosing of a use of the impacted section over a presented bypass choice, the impacted section-choice toll rate relatively lower than the bypass-choice rate.

20. The programmable device of claim 18, wherein each of a plurality of bypass choices has a traffic flow capacity, and wherein a first of the bypass choices has a first traffic flow capacity greater than a second traffic flow capacity of a second of the bypass choice, and wherein the processing means is configured to set a first bypass-choice toll rate for association with the first bypass choice lower than a second bypass-choice toll for association with the second bypass choice as a function of a difference between the first traffic flow capacity and the second traffic flow capacity.

* * * * *